US005272965A

United States Patent [19]

Löffler

[11] Patent Number: 5,272,965

[45] Date of Patent: Dec. 28, 1993

[54] RAIL GUN

[75] Inventor: Markus Löffler, Unterlüss, Fed. Rep. of Germany

[73] Assignee: TZN Forschungs- und Entwicklungszentrum Unterlüss GmbH, Unterlüss, Fed. Rep. of Germany

[21] Appl. No.: 957,767

[22] Filed: Oct. 16, 1992

[30] Foreign Application Priority Data

Oct. 25, 1991 [DE] Fed. Rep. of Germany ..... 4135274

[51] Int. Cl.[5] ..... F41B 6/00

[52] U.S. Cl. ..... 89/8; 124/3

[58] Field of Search ..... 89/8; 124/3

[56] References Cited

U.S. PATENT DOCUMENTS 4,953,441 9/1990 Weldon et al. ..... 89/8

5,142,962 9/1992 Hawke ..... 89/8

OTHER PUBLICATIONS

Marshall et al, "The 10 KM/S, 10 KG Railgun", IEEE Transactions on Magnetics, vol. 27, No. 1, Jan. 1991, pp. 21-27.

Usuba et al, "Performance of the Discrete Electrode Railgun", IEEE Transactions on Magnetics, vol. 27, No. 1, Jan. 1991, pp. 611-616.

*Primary Examiner*—Stephen C. Bentley

*Attorney, Agent, or Firm*—Spencer, Frank & Schneider

[57] ABSTRACT

A rail gun for accelerating a projectile therein includes a hollow insulating body forming a gun tube; and two rail assemblies supported in the gun tube and together defining an acceleration channel to accommodate a projectile for being propelled therein by a plasma armature generated by a high intensity current flowing through the rail assemblies and an electric arc connecting the rail assemblies. At least one of the rail assemblies includes a layer of an electrically conducting metal wool mass extending along and bounding the acceleration channel and an insulating substance held in the metal wool mass.

6 Claims, 1 Drawing Sheet

RAIL GUN

BACKGROUND OF THE INVENTION

The present invention relates to a rail gun for accelerating a projectile by a plasma armature generated in an acceleration channel defined by at least two electrical conductor rails.

In a simple embodiment, conventional rail guns are composed of two parallel arranged current-conducting rails which are connected with a high-intensity current source. To accelerate the projectiles, the trailing end of the projectile has an armature that acts as a current bridge between the two rails. An article by R. A. Marshall et al, entitled "The 10 km/s, 10 kg Railgun", in IEEE Transactions on Magnetics, Vol. 27, pages 21 et seq., discloses the use of a plasma which constitutes the armature (plasma armature) and which is generated by an electric arc. The current then flows from the high-intensity current source through one rail and through the electric arc to the other rail which returns the current to the high-intensity current source. The interaction of the magnetic field generated in this current loop with the arc current causes an electromagnetic force (Lorentz force) which accelerates the arc and thus also accelerates the projectile in front of the arc.

In principle, projectiles may be accelerated to significantly greater velocities in rail guns than in gas guns. The above-noted article by Marshall et al indicates, however, that the formation of parasitic electric arcs observed at high projectile velocities leads to a velocity limitation of about 6 km/s.

An article by S. Usuba et al entitled "Performance of the Discrete Electrode Railgun", in IEEE Transactions on Magnetics, Vol. 27, pages 611 et seq. discloses a suppression of parasitic arcs by dividing at least one of the current rails into discrete electrodes. Once the arc has burnt for a length of time on a rearward discrete electrode, the current flow in that electrode is discontinued by means a fuse isolating that part of the current rail. The arc then fires on the next following electrode in the direction of acceleration and is subsequently switched off with the aid of a fuse. This process is repeated until the projectile has left the rail gun.

It is a drawback of the device described in the Usuba et al article that a considerable amount of energy must be generated to commutate the current from one fuse to the next. This is so, because the relatively large current loops formed by the fuses and the current rail must be charged with magnetic energy, which requires the generation of a high reactive and high active power. A further disadvantage resides in the fact that the fuses must be matched very precisely to the acceleration process and the generated currents. Thus, in case of a mismatch, the fuses may respond too early or too late if they respond at all.

SUMMARY OF THE INVENTION

It is an object of the present invention to provide an improved rail gun of the above-discussed type which may accelerate projectiles in a simple manner to high velocities in the absence of parasitic arcs without the need for constructing the current rails of individual electrodes and for providing additional fuse elements.

This object and others to become apparent as the specification progresses, are accomplished by the invention, according to which, briefly stated, the rail gun for accelerating a projectile therein includes a hollow insulating body forming a gun tube and two rail assemblies supported in the gun tube and together defining an acceleration channel to accommodate a projectile for being propelled therein by a plasma armature generated by a high intensity current flowing through the rail assemblies and an electric arc connecting the rail assemblies. At least one of the rail assemblies includes a layer of an electrically conducting metal wool mass extending along and bounding the acceleration channel and an insulating substance held in the metal wool mass.

Thus, the present invention is essentially based on the concept of constructing at least one rail of the rail gun in its entirety or at least that rail side which bounds the acceleration channel, of a layer of metal wool mass holding (for example, by impregnation) an insulating substance. The forces derived from the current radially compress the metal wool layer in its thickness behind the arc, causing the insulating substance to be pushed out of the metal wool layer and thrown in part into the acceleration channel. This insulates the metal wool layer (and the solid rail components, if present) from the acceleration channel. The insulating particles that are thrown into the channel also insulate the arc from the rear portion of the acceleration channel.

DESCRIPTION OF THE PREFERRED EMBODIMENT

Figure 1:
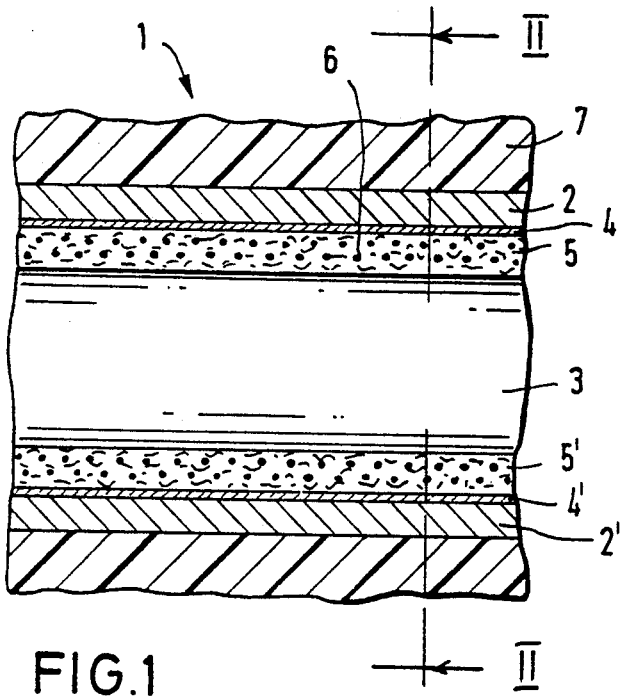
FIG. 1 is a fragmentary axial sectional view of a rail gun according to a preferred embodiment of the invention.
Figure 3:
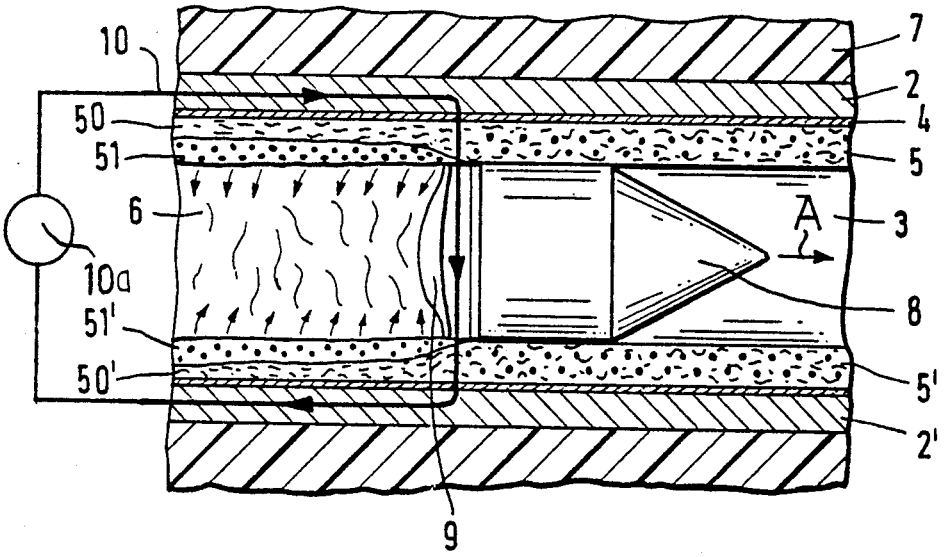
FIG. 3 is a view similar to FIG. 1 showing a projectile in the rail gun during acceleration.

In FIGS. 1 and 3, a length portion of a rail gun 1 is illustrated.

The rail gun 1 includes an outer, glass fiber reinforced plastic hollow insulating body 7 which accommodates two oppositely located rail assemblies, together defining an acceleration channel 3 in which a projectile 8 moves. Each rail assembly includes a solid rail component 2 and 2', respectively, which may be of copper or another material having superior electrically conducting properties.

According to the present invention, layers 5 and 5' of a metal wool mass are fastened to rails 2 and 2', respectively, for example, by way of hard brazing layers 4 and 4'. The metal wool mass is formed, for example, by many intertwined, tangled, hair-thin wires of aluminum, copper, iron or other electrically conductive material. The metal wool mass has thus a mat-like or sponge-like construction. The metal wool layers 5, 5' which form part of the rail assemblies hold an insulating material, such as bitumen, wax, high-viscosity oil or, in general, an insulating material—for example, an epoxy resin—which melts above 40° C. Thus, to provide the metal wool mass with the insulating material, the metal wool mass is dipped into the liquid insulating material. Thereafter the metal wool mass impregnated with the insulating material is removed, the insulating material in the metal wool mass is allowed to cool and thus solidify. It is noted that the density (total volume) of the metal in the metal wool mass is preferably at least one half of the thickness of each layer 5, 5'. Discrete particles of the insulating material are designated at 6. At their surfaces oriented toward the acceleration channel 3, the metal wool layers 5 and 5' are exposed so that they can be electrically connected with one another by an electric arc.

Figure 2:
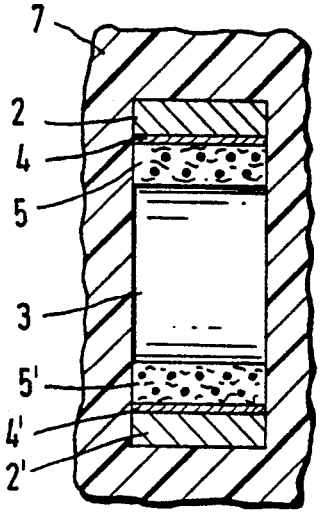
FIG. 2 is a sectional view taken along lines II—II of FIG. 1.

Also referring to FIG. 2, the rails 2 and 2' as well as the metal wool layers 5 and 5' are conventionally immobilized by friction inside the hollow insulating body 7. It is seen that the acceleration channel 3 is closed on all sides.

Referring in particular to FIG. 3, the projectile 8 disposed in the acceleration channel 3 moves toward the muzzle of the gun 1 as indicated by arrow A. Immediately behind the projectile 8 a plasma armature is located that is formed by an electric arc 9. The current 10 flows through rail 2, metal wool 5, arc 9, metal wool 5' and rail 2' out of and back into a high-intensity current source 10*a*.

The forces derived from the current 10 compress the metal wool layers 5 and 5' in their thickness behind the arc 9. The compressed length portions of the metal wool layers are designated at 50 and 50'. As a result of the compression, the insulating substance composed of insulating particles 6 is pushed out of the metal wool layers 5 and 5' and form insulating layers 51 and 51' which are separate from and are located inwardly of the compressed length portions 50, 50' of the respective layers 5, 5'. Eventually, one part of the insulating substance is also thrown into the acceleration channel 3 in a solid, liquid or gaseous state. The energy losses are derived only from the required compression work, that is, commutation losses do not occur.

By virtue of the insulating layers 51 and 51' the rails 2 and 2' as well as the compressed lengths 50, 50' of the metal wool layers 5 and 5' are electrically insulated from the acceleration channel 3. The insulating substance thrown into the acceleration channel 3 additionally provides that the arc 9 is insulated from the rearward portion of the acceleration channel 3. Thus, the arc 9 is no longer able to fire parasitic arcs anywhere in that part of the acceleration channel 3 through which the projectile 8 has already passed.

The arc 9 driving the projectile 8 is concentrated in a narrow region behind the projectile 8, so that the driving electromagnetic force remains concentrated entirely on the arc-and-projectile arrangement. The width of this region is determined by the inertia and viscosity of the substance of the material 5, 5' compressed by the current forces and by the intensity of current 10. After firing, the two rails 2 and 2' together with metal wool layers 5 and 5' are replaced with new, unused ones.

It is feasible to provide only one of the two rails with a metal wool layer. In that case, the other rail contacts the projectile directly. It is further feasible to omit the solid rails 2, 2' and to utilize, as the rail assembly, solely the metal wool layers 5, 5' containing the insulating substance.

It will be understood that the above description of the present invention is susceptible to various modifications, changes and adaptations, and the same are intended to be comprehended within the meaning and range of equivalents of the appended claims.

What is claimed is:

1. A rail gun for accelerating a projectile therein, comprising (a) a hollow insulating body forming a gun tube;

(b) two rail assemblies supported in the gun tube and together defining an acceleration channel to accommodate a projectile for being propelled therein by a plasma armature generated by a high intensity current flowing through the rail assemblies and an electric arc connecting the rail assemblies; at least one of said rail assemblies including (1) a layer of electrically conducting metal wool mass extending along and bounding said acceleration channel and (2) an insulating substance held in said metal wool mass.

2. The rail gun as defined in claim 1, wherein said insulating substance comprises bitumen.

3. The rail gun as defined in claim 1, wherein said insulating substance comprises wax.

4. The rail gun as defined in claim 1, wherein said insulating substance comprises discrete particles.

5. The rail gun as defined in claim 1, wherein said metal wool mass is impregnated with said insulating substance.

6. The rail gun as defined in claim 1, wherein said one rail assembly comprises an electrically conducting solid rail component extending along said acceleration channel and being secured to said metal wool mass; said metal wool mass being situated between said acceleration channel and said solid rail component.

* * * * *